United States Patent [19]

Inculet et al.

[11] 4,279,625

[45] Jul. 21, 1981

[54] ELECTROSTATIC SYSTEM FOR CONCENTRATING, PROPELLING AND COLLECTING AIRBORNE PARTICULATES FOR INDUSTRIAL FURNACES

[75] Inventors: Ion I. Inculet; George S. P. Castle; John L. Sullivan, all of London, Canada

[73] Assignee: Canadian Patents & Development Ltd., Ottawa, Canada

[21] Appl. No.: 79,077

[22] Filed: Sep. 26, 1979

[51] Int. Cl.[3] ..... B03C 3/12; F23J 15/00; C21B 7/22

[52] U.S. Cl. ..... 55/131; 55/138; 55/385 D; 110/216; 98/58; 266/157; 266/159

[58] Field of Search ..... 55/131, 138, 385 D; 110/119, 216; 126/280; 98/58; 361/231; 266/157, 159

[56] References Cited

U.S. PATENT DOCUMENTS

| | | | |
|---|---|---|---|
| 3,664,092 | 5/1972 | Vincent | 55/131 |
| 3,877,898 | 4/1975 | Nomura et al. | 266/157 |

FOREIGN PATENT DOCUMENTS

| | | | |
|---|---|---|---|
| 2147677 | 3/1973 | Fed. Rep. of Germany | 55/138 |
| 581530 | 12/1923 | France | 55/131 |
| 167939 | 8/1921 | United Kingdom | 55/131 |

*Primary Examiner*—David L. Lacey
*Attorney, Agent, or Firm*—James R. Hughes

[57] ABSTRACT

A system of corona injection and repelling electrodes are positioned such that airborne particulates are charged in situ and are propelled to collecting grids above a furnace, or concentrated into particle streams directed into ventilation hoods to be collected by low volume, high efficiency precipitators.

2 Claims, 4 Drawing Figures

Figure 2:
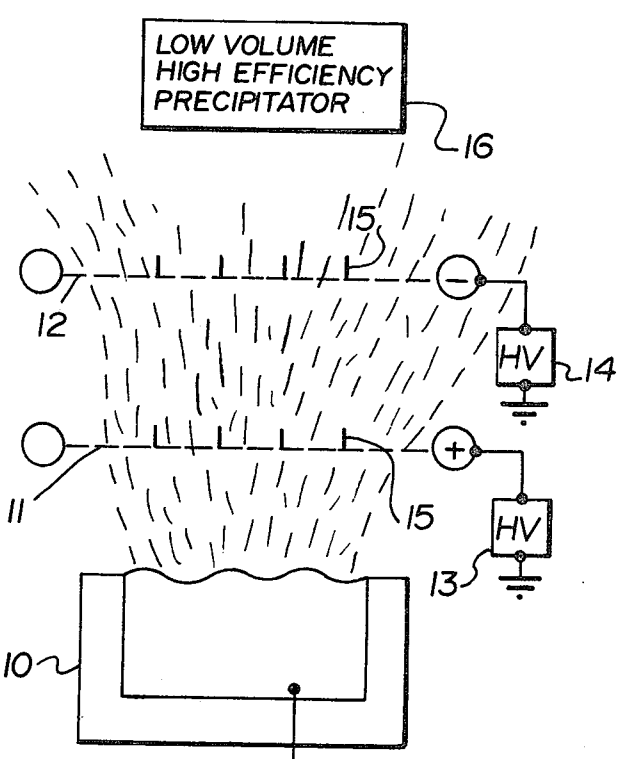

ELECTROSTATIC SYSTEM FOR CONCENTRATING, PROPELLING AND COLLECTING AIRBORNE PARTICULATES FOR INDUSTRIAL FURNACES

This invention relates to an apparatus for the ductless collection of fumes and more particularly to an electrostatic system of confining, precipitating, or propelling airborne particulate material to specific locations in a manufacturing area.

There are certain specific industries, such as silicon-carbide manufacturing, asbestos processing, or foundries in general, with particulate emissions which are characterized by:

(1) relatively small quantities when compared, for example, to the fly ash produced in a coal burning power plant.

(2) not being harmful to the process itself if some means could be found of confining and returning such particulates back to the surface from where they originated.

Experimental tests have shown the effectiveness of the dissipation of dust clouds by charging them with a mobile corona grid. At the time it was envisaged that the system could be applied in foundries where the particulate emissions could be charged and propelled back on to the foundry floor. In some subsequent work it was demonstrated that in lieu of a mobile corona grid one may use fixed corona injection points very effectively.

It is believed that by arranging such corona injection points at strategic locations above the emission area, and combining them with suitable low surge electrodes, the airborne particulate emissions would be charges in situ, and confined, precipitated or propelled to specified locations in the manufacturing area.

It is an object of the invention to provide a system for directing and precipitating fumes, such that the requirement and capacity of conventional dust collectors such as precipitators, scrubbers, bag houses, etc may be reduced.

This and other objects of the invention are achieved by a system of corona injection and repelling electrodes adapted to the specific process and positioned such that airborne particulates are charged in situ and are propelled to collecting grids above the furnace, or concentrated into particle streams directed into ventilation hoods to be collected by low volume, high efficiency precipitators.

Figure 1:
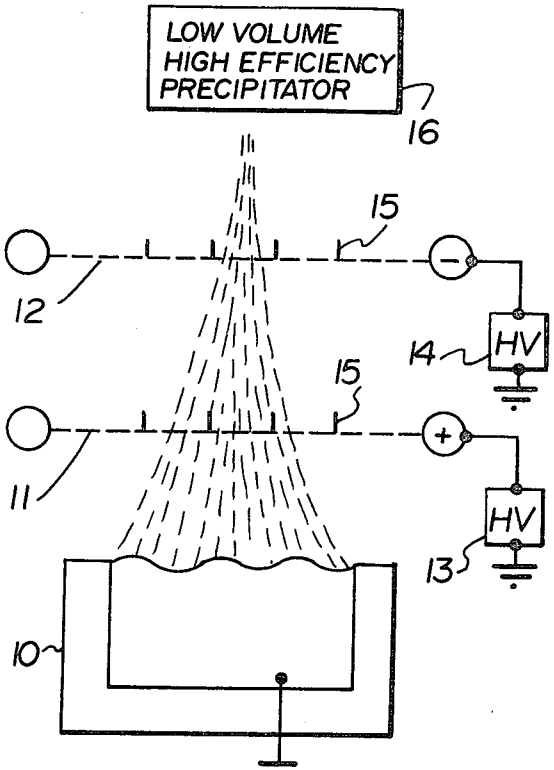
Figure 4:
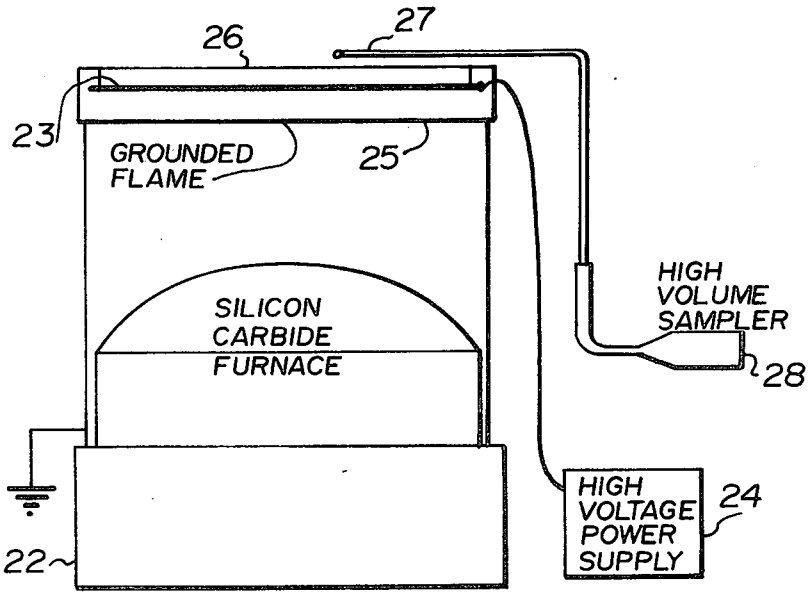
Figure 3:
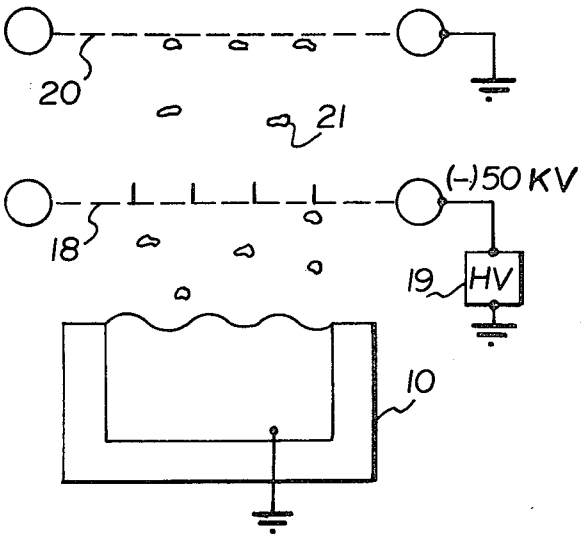

In the drawings which illustrate the invention,

FIGS. 1 and 2 show the ductless collection of fumes with power on and off, FIG. 3 shows the collection of particles on a two-grid system, and FIG. 4 is a schematic of a silicon carbide precipitator and test equipment.

Silicon-carbide is manufactured in batch-type electric resistance furnaces by reactions between carbon (coke) and silica (sand). The reactions are usually written:

$$SiO_2+2C \rightarrow Si+2C0 \quad \text{(i)}$$

$$Si+C \rightarrow SiC \quad \text{(ii)}$$

To accomplish these reactions, high temperatures are needed and the electric resistance heating is the most convenient method of providing the thermal energy. After passing the required current for sufficient time to produce the silicon-carbide, the furnace is shut off and allowed to cool. The product is then removed, graded and subjected to other processes as may be needed.

As the furnaces are usually very large and are difficult to enclose, gaseous and particle emissions are removed from the workroom air by hoods or general ventilation and discharged to the atmosphere. The particles which are produced come from the reversal of reaction (i) which may occur due to uneven temperature distribution in the furnace. This is inevitable in electric resistance furnaces where the highest temperatures are achieved between the electrode pairs. In addition to the reversal of the reaction, it might be possible for some of the silicon to be oxidized by leakage of air through the sides of the furnace. Other particulates likely to occur are metal oxides derived from impurities in the coke and sand. Unlike the original raw materials the particle sizes produced in the furnace are very fine, mainly in the 1 micrometre range or less. Other particles could originate from (a) volatile matter which often remains in small quantities in coke as tarry constituents, and (b) organic matter in the sand. Visually, the particulate discharge appears as a light colored cloudy haze resulting from silica and metal oxides, or grey if carbon is present.

FIGS. 1 and 2 show an arrangement for ductless collection of fumes from a furnace 10 the contents of which are held at ground potential. Two grids 11 and 12, one of which is maintained at a high positive potential by means of a suitable HV supply 13 and the other at a negative potential by means of a suitable HV supply 14, with corona points 15 directed upwards so as to concentrate and direct the particulates and the fumes present in the thermal updraft towards a low volume high efficiency electrostatic precipitator 16. FIG. 1 shows the concentrating action of the grids when the voltage is on as compared to the general diffusion when the power is off and the grids are inoperative.

FIGS. 1 and 2 show that only two grids of opposite polarities have been found to both concentrate and convey the fumes generated from the surface of the furnace towards the precipitator intake, maintained at ground electrical potential. There is also some collection of particles on grid 12.

FIG. 3 shows a system for collection of particles on a two-grid system. Again the content of furnace 10 is held at ground and the lower grid 18 is held at a high negative potential (e.g. 50 kV) by HV supply 19. Upper grid 20 is at ground potential. The particulates are charged and concentrated by the lower grid and are collected on the upper grid. These may be shaken or scraped off at convenient times. Alternatively upper grid 20 could be replaced by a series of wires arranged to move through the precipitation region to an external collection area.

FIG. 4 shows an experimental set-up with a silicon carbide furnace, for example. Furnace 22 has mounted above it, a high voltage grid 23 connected to a suitable high voltage power supply 24, and positioned between grounded grids 25 and 26. A sampling probe 27 is connected to a high volume sampler 28.

The results of a series of tests is shown in following Table I:

TABLE I

| Test # | High Voltage | Collection Per Grid Area Relative to Least Amount | % more collected With High Voltage On |
|---|---|---|---|
| 1A | ON | 23.55 | 264 |
| 1B | OFF | 8.91 | |
| 2A | ON | 6.27 | 276 |
| 2B | OFF | 2.27 | |
| 3A | ON | 2.64 | 264 |
| 3B | OFF | 1.00 | |
| 4A | ON | 4.64 | 341 |
| 4B | OFF | 1.36 | |

This table shows the collection of the upper grid which is maintained at ground electrical potential. Under normal conditions, without any voltage applied to the corona wires, some of the very fine fumes collect on the grid. When the negative 45 kV potential is applied to the corona wires, the amounts which were collected on the grid increased anywhere from 264 to 341%.

Table II presents the amounts collected by the high volume sampler mounted directly above the collection grids.

TABLE II

| Test # | High Voltage | Collection on Filter Relative to Least Amount | % Less collected with high voltage on |
|---|---|---|---|
| 5A | ON | 2.39 | 20.3 |
| 5B | OFF | 3.00 | |
| 6A | ON | 1.52 | 44.7 |
| 6B | OFF | 2.75 | |
| 7A | ON | 1.00 | 36.7 |
| 7B | OFF | 1.58 | |

The results show that the amounts collected when the −45 kV is applied to the corona wires decrease anywhere from 20.3 to 44.7%.

It has been found that useful results will be obtained with potentials on grids in the range 7 to 200 kilovolts with very good results being obtained at about 50 kilovolts.

We claim:

1. An electrostatic system in combination with an industrial furnace for concentrating and propelling airborne particulates from the said furnace to a collection area comprising:
   (a) a first corona injection and repelling open grid electrode positioned directly above the furnace in the path of the particulates rising from the furnace,
   (b) means for applying a high positive or negative voltage in the range of 7 to 200 kV to the first electrode,
   (c) a second corona injection and repelling open grid electrode positioned directly above the first electrode,
   (d) means for applying a high voltage opposite in polarity to the voltage applied to the first electrode and in the range 7 to 200 kV to the second electrode, and
   (e) means for grounding said furnace.

2. An electrostatic system in combination with an industrial furnace for concentrating, propelling and collecting airborne particulates from the said furnace comprising:
   (a) a first open grid electrode acting as a corona injection and repelling electrode positioned directly above the furnace in the path of the particulates rising from the furnace,
   (b) means for applying a high positive or negative voltage in range of 7 to 200 kV to the first electrode,
   (c) a second open grid electrode positioned directly above the first electrode acting as a collecting grid,
   (d) means for grounding said second electrode, and
   (e) means for grounding said furnace.

* * * * *